US006476921B1

(12) United States Patent
Saka et al.

(10) Patent No.: US 6,476,921 B1
(45) Date of Patent: Nov. 5, 2002

(54) IN-SITU METHOD AND APPARATUS FOR END POINT DETECTION IN CHEMICAL MECHANICAL POLISHING

(75) Inventors: Nannaji Saka, Cambridge, MA (US); Jamie Nam, Ninilchik, AK (US); Hilario L. Oh, Rochester Hills, MI (US)

(73) Assignees: ASML US, Inc., Scotts Valley, CA (US); Massashusetts Institute of Technology, Cambridge, MA (US)

( * ) Notice: Subject to any disclaimer, the term of this patent is extended or adjusted under 35 U.S.C. 154(b) by 22 days.

(21) Appl. No.: 09/628,471

(22) Filed: Jul. 31, 2000

(51) Int. Cl.[7] ..... G01B 11/14; B24B 49/00

(52) U.S. Cl. ..... 356/630; 451/6

(58) Field of Search ..... 356/445, 625, 356/630, 38, 326, 328; 451/6, 285–288, 41, 63, 28, 397, 398

(56) References Cited

U.S. PATENT DOCUMENTS

| | | | | |
|---|---|---|---|---|
| 5,433,651 A | | 7/1995 | Lustig et al. | 451/6 |
| 5,672,091 A | | 9/1997 | Takahashi et al. | 451/6 |
| 5,835,225 A | | 11/1998 | Thakur | 356/381 |
| 5,838,448 A | | 11/1998 | Aiyer et al. | 356/382 |
| 5,916,016 A | * | 6/1999 | Bothra | 451/398 |
| 5,953,115 A | | 9/1999 | Landers et al. | 356/237 |
| 5,964,643 A | | 10/1999 | Birang et al. | 451/6 |
| 5,972,787 A | | 10/1999 | Boggs et al. | 438/633 |
| 5,985,679 A | | 11/1999 | Berman | 438/7 |
| 6,004,187 A | | 12/1999 | Nyui et al. | 451/5 |
| 6,068,539 A | | 5/2000 | Bajaj et al. | 451/6 |
| 6,071,177 A | * | 6/2000 | Lin et al. | 451/6 |
| 6,074,287 A | | 6/2000 | Miyaji et al. | 451/287 |
| 6,077,452 A | | 6/2000 | Litvak | 216/85 |
| 6,179,956 B1 | * | 1/2001 | Nagahara et al. | 156/345 |
| 6,204,922 B1 | * | 3/2001 | Chalmers | 356/381 |
| 6,290,584 B1 | * | 9/2001 | Kim et al. | 451/288 |

FOREIGN PATENT DOCUMENTS

| | | | |
|---|---|---|---|
| EP | 0881484 | 2/1998 | G01N/21/00 |

OTHER PUBLICATIONS

Adams, et al., "*Process Control and Endpoint Detection with Fullscan ISRM System in Chemical Mechanical Polishing of Cu Layers*," CMP–MIC, Mar. 2000, 5 pages.

Bonner et al., "*Removal Rate, Uniformity and Defectivity Studies of Chemical Mechanical Polishing of BPSG Films*," MRS, Spring 2000, 6 pages.

Garretson et al., "*New Pad Conditioning Disk Design Delivers Excellent Process Performance While Increasing CMP Productivity*," CMP Technology for ULSI Interconnection, SEMICON West 2000, 9 pages.

Osterheld et al., "*A Novel Retaining Ring in Advanced Polishing Head Design for Significantly Improved CMP Performance*," MRS, Apr. 5–9, 1999, 8 pages.

(List continued on next page.)

*Primary Examiner*—Michael P. Stafira
(74) *Attorney, Agent, or Firm*—Dorsey & Whitney LLP

(57) ABSTRACT

A method and apparatus for providing in-situ monitoring of the removal of materials in localized regions on a semiconductor wafer or substrate during chemical mechanical polishing (CMP) is provided. In particular, the method and apparatus of the present invention provides for detecting the differences in reflectance between the different materials within certain localized regions or zones on the surface of the wafer. The differences in reflectance are used to indicate the rate or progression of material removal in each of the certain localized zones.

17 Claims, 7 Drawing Sheets

OTHER PUBLICATIONS

Römer et al., "*STI CMP Using Fixed Abrasive Demands, Measurement Methods and Results*," CMP–MIC, Mar. 2000, 10 pages.

Surana et al., "*Defectivity Reduction in Copper CMP Processes*," VMIC, Jun. 2000, 3 pages.

Tang, et al., "*Novel Integrated Single Wafer Immersion Megasonics for Advanced Post CMP Cleaning in a Next Generation Dry–in Dry–out CMP System*," CMP–MIC, Mar. 2000, 5 pages.

* cited by examiner

IN-SITU METHOD AND APPARATUS FOR END POINT DETECTION IN CHEMICAL MECHANICAL POLISHING

RELATED APPLICATIONS

The present invention is related to co-pending U.S. patent application Ser. No. 09/628,563 filed simultaneously herewith and is incorporated by reference in its entirety.

BRIEF DESCRIPTION OF THE INVENTION

The present invention relates to an in-situ method and apparatus for end point detection during chemical mechanical polishing, and more particularly to a method and apparatus in which localized areas of the surface of a semiconductor wafer or substrate which is undergoing chemical mechanical polishing are monitored to detect the removal of material from the localized wafer surface areas.

BACKGROUND OF THE INVENTION

Manufacture of semiconductors has become increasingly complex as the device densities increase. Such high density circuits typically require closely spaced metal interconnect lines and multiple layers of insulating material, such as oxides, formed atop and between the interconnect lines. Surface planarity of the semiconductor wafer or substrate degrades as the layers are deposited. Generally, the surface of a layer will have a topography that conforms to the sublayer, and as the number of layers increase the non-planarity of the surface becomes more pronounced.

To address the problem, chemical mechanical polishing (CMP) processes are employed. The CMP process removes material from the surface of the wafer to provide a substantially planar surface. More recently, the CMP process is also used to fabricate the interconnecting lines. For example, when depositing copper leads or interconnect lines, a full layer of the metal 13 is deposited on the surface of the wafer 10 having grooves 12 formed in an oxide layer 11 as shown in FIGS. 1A and 1B. The metal layer 13 may be deposited by sputtering or vapor deposition or by any other suitable conventional technique. The oxide layer, such as doped or undoped silicon dioxide, is usually formed by chemical vapor deposition (CVD). The metal layer covers the entire surface of the wafer and extends into the grooves. Thereafter, individual leads 16 are defined by removing the metal layer from the surface of the oxide. The CMP process may be used to remove the surface metal leaving the leads 16 in the grooves. The leads are insulated from one another by the intervening oxide layer.

In general, to carry out the CMP process, a chemical mechanical polishing (CMP) machines is used. Many types of CMP machines are used in the semiconductor industry. CMP machines typically employ a rotating polishing platen having a polishing pad thereon, and a smaller diameter rotating wafer carrier which carries the wafer whose surface is to be planarized and/or polished. The surface of the rotating wafer is held or urged against the rotating polishing pad. A slurry is fed to the surface of the polishing pad during polishing of the wafer.

It is desirable to precisely determine when the material has been removed from the upper surface of the wafer during the CMP process. This not only prevents discarding of over-polished wafers, but also minimizes the necessity of re-polishing any under-polished wafers. There are many possible ways of determining when to stop the CMP process. Typical methods include: (1) detecting frictional change as the top layer of metal is polished away to expose the silicon oxide layer by monitoring the current to the platen and carrier motors, and (2) monitoring thermal and acoustic signatures from the polishing pad. Electrical impedance, conductance and capacitance can also be used to determine the presence of the metal layers.

More recently, optical measurement has been used in the art with the CMP process. For example, U.S. Pat. No. 5,838,448 uses interferometry and describes detecting the thickness of a thin layer, or the changes in the film thickness, by measuring reflectance variations caused by a change in the incidence angle of incident light. U.S. Pat. No. 5,835,225 describes using reflectance measurements to determine a particular surface property of the substrate. U.S. Pat. No. 5,433,651 describes a method and apparatus for viewing the wafer during polishing and end-pointing the CMP process when a prescribed change in the in-situ reflectance corresponds to a prescribed condition of the polishing process.

While these techniques have provided improvements to the CMP process, these methods provide average (global) characteristics of the whole wafer surface, rather than those of smaller, localized regions or areas of the wafer. This means that, although one part of the wafer may get polished before another, the global system is not typically able to differentiate between over-polished and under-polished regions of the wafer.

In another prior art technique, as described in U.S. Pat. No. 5,972,787, indicator areas are provided on the wafer. These indicator areas are formed of blocks of parallel metal lines with varying line widths and pattern factors that are chosen to violate existing ground rules in such a way that they will be dished out using the standard consumable set (pad/slurry) of a given metal CMP process. The blocks are then inspected to determine the extent of polishing. While this technique provides for indicating the polishing in certain areas of the wafer, the process requires that the CMP step be interrupted for the inspection to take place. Further, the indicator areas require formation of the blocks which add an additional step to the already complex fabrication process. Accordingly, there is a need for an improved method and apparatus that can continuously, and in-situ, monitor localized regions of the wafer surface during the CMP process.

SUMMARY OF THE INVENTION

It is an object of the present invention to provide an in-situ method and apparatus for monitoring localized regions of the wafer surface during the CMP process.

It is another object of the present invention to provide a method and apparatus which continuously monitors the polishing progress at different areas of the wafer, and may also be used to determine the end point for removal of material from the surface of the wafer.

It is a further object of the present invention to provide a method and apparatus which employs the difference in reflectance between different materials on a wafer to monitor the polishing progress and/or end point at selected regions on the wafer surface.

It is a further object of the present invention to provide a method and apparatus which monitors reflectance at various surface areas of the wafer and controls the polishing process at said areas to achieve substantially uniform removal of metal during polishing.

The foregoing and other objects of the invention are achieved by a chemical mechanical polishing method and apparatus in which a rotating polishing platen and polishing pad of a first diameter polishes a wafer carried by a wafer carrier. A window is formed in the polishing platen and pad whereby said window periodically scans across the underside of the wafer. An optical detector, such as a fiber optic cable, transmits light through the window onto the surface of the carrier and receives light reflectance through the window from said wafer surface as it rotates past the window and means are provided for monitoring the reflected light, and for controlling the polishing process at localized regions of the wafer responsive to the reflected light information.

More specifically, the chemical mechanical polishing method and apparatus includes a wafer carrier that has a membrane having a central and concentric pressure chambers or compartments which define corresponding zones or regions on the wafer surface. An actuator is provided to control the pressure applied to the central and concentric compartments and thereby control the rate of removal of material from the wafer surface at each of the corresponding zones, and the actuator is engaged responsive to reflected light received at each of the zones.

In another aspect of the present invention, a method of chemical mechanical polishing is provided comprising the steps of: providing a CMP machine which includes a polishing pad and a wafer carrier having multiple chambers that allow for independently varying pressure within the chambers that urge against a wafer at corresponding localized regions on the wafer; measuring the reflectance of the surface of the wafer during polishing at each of the localized regions on the wafer; processing the reflectance data to determine the state of polishing within each of the localized regions; and independently adjusting the pressure within any one of the chambers responsive to the state of polishing within each of the corresponding localized regions.

BRIEF DESCRIPTION OF THE DRAWINGS

The foregoing and other objects and features of the invention will be more clearly understood from the following description when read in connection with the accompanying drawings in which.

DETAILED DESCRIPTION OF THE INVENTION

The inventors have discovered a method and apparatus for providing in-situ monitoring of the removal of materials in localized regions on a semiconductor wafer or substrate during chemical mechanical polishing (CMP). In particular, the method and apparatus of the present invention provides for detecting the differences in reflectance between different materials, such as conductive, insulating and barrier materials, within certain localized regions or zones on the surface of the wafer. The differences in reflectance are used to indicate that the top or bulk material has been removed in each of the localized zones. In the preferred embodiment this information is used to provide real-time control of the CMP process.

Figure 1A:
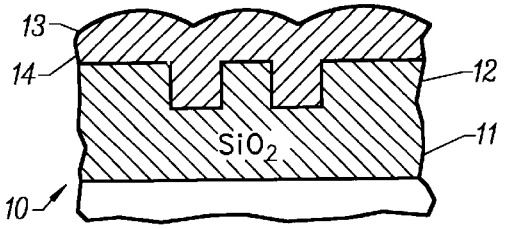
FIGS. 1A and 1B show the surface of a wafer with a trenched oxide coating with conductive interconnect material applied to the surface, FIG. 1A, and polished, FIG. 1B, to leave leads.
Figure 1B:
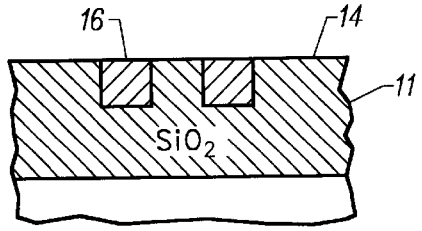
Figure 2:
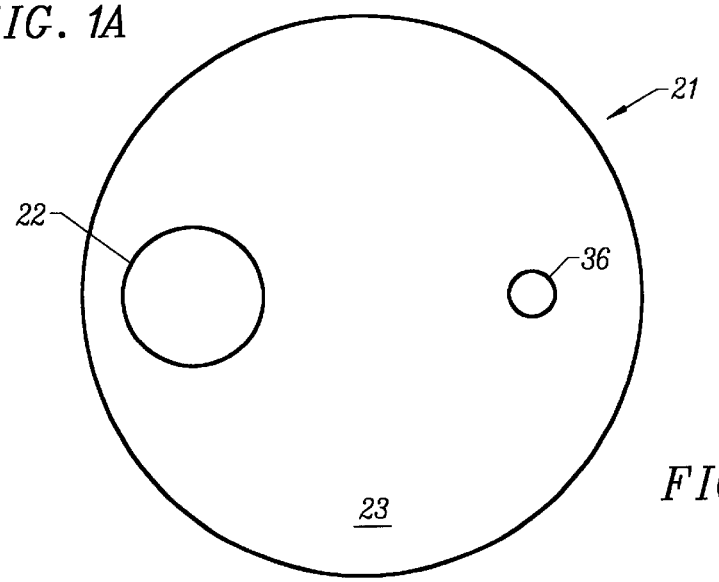
FIG. 2 is a top plan view of a rotating polishing platen and polishing pad with a wafer carrier and observation window in accordance with the present invention.
Figure 3:
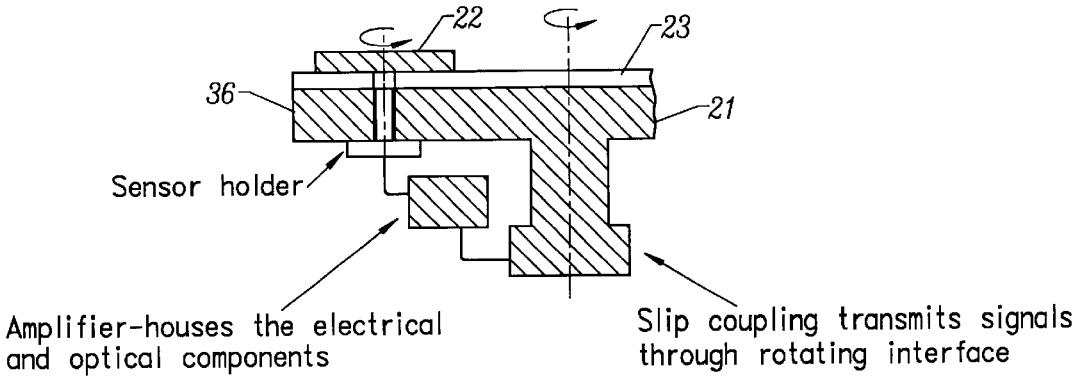
FIG. 3 is a partial sectional view showing the rotating polishing platen, polishing pad and wafer carrier in accordance with the present invention.

Specifically, referring to FIGS. 2 and 3 is shown a portion of a CMP machine which includes a rotating platen 21 and a rotating wafer 22 carried by a wafer carrier (not shown) in accordance with one embodiment of the present invention. The platen 21 carries a polishing pad 23 onto which a polishing slurry is applied during the CMP process. The CMP machine in the present embodiment is employed to remove surface material, either a conductive or insulating material, from the surface of the wafer. In one embodiment, the surface material is a metal, and the metal is removed from the wafer surface to leave conductors imbedded in trenches in an insulating layer. The conductive material can be any suitable conductor such as aluminum or copper. The insulating material can be any suitable insulator such as un-doped silicon dioxide, silicon oxide doped with boron, phosphorous, or both, or low dielectric constant materials. Also, the present invention may be used to remove conductive or insulating materials to expose a barrier material, such as TaN and the like. Further, the barrier layer may also be removed. In one embodiment the present invention is directed to a method for detecting surface metal removal to fabricate a structure such as that schematically illustrated in FIG. 1B. The present invention exploits the reflective differences between the conductive (typically metal) and the insulating materials to monitor the progress of planarizing of the wafer, and to determine which localized regions are nearing removal of the material and thus the end point of the polishing process.

Figure 8:
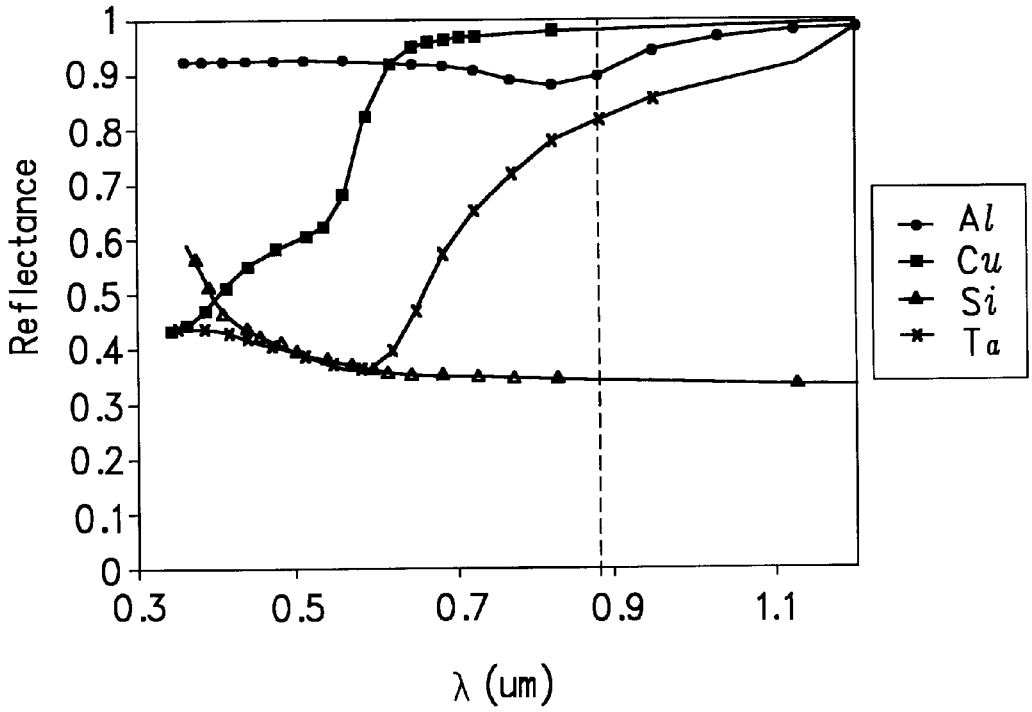
FIG. 8 shows reflectance as a function of wavelength for various materials.

To monitor the CMP process, the difference in reflectance between the conductive and the insulating materials are observed. The preferred conductive materials used for leads in semiconductor devices are aluminum and copper, which are approximately 90–95% reflective for light around one micrometer in wavelength. The reflectance as a function of wavelength for copper, aluminum, silicon and tantalum are shown in FIG. 8. Most insulating materials such as silicon oxide are, as can be seen from FIG. 8, 25–30% reflective at the same wavelength. This difference in reflectance is used to monitor the polishing process. During the CMP process, the pre-polished reflectance from the wafer surface is expected to be about 90% due to full coverage of metal on the surface of the wafer. Upon completion of the CMP process the post-polish reflectance is expected to be lower; in one example in the range of about 25–60%, because the exposed surface has a mixture of insulating material and the metal conductors in the trenches. It is important to note that the these numbers are given for general purposes only, and that the actual different in reflectance between the conductive and insulating or barrier materials will vary primarily based on the type of material and on the pattern and pattern density on the surface of the wafer. In general, lower the density of the metal lines on the patterned wafer, the lower the reflectance value. In one exemplary embodiment of the present invention, the difference in reflectance between the conductive material, and the reflectance value which indicates that the CMP process is nearing completion or is substantially complete at a given zone, is observed to be up to about 65%. Again, the actual difference in reflectance will vary dependent on a number of factors, such as for example the type of material, whether the material is in bulk or patterned, the pattern density, the wavelenght of the light, and the surface finish of the wafer (which may reduce the reflectance).

Figure 6:
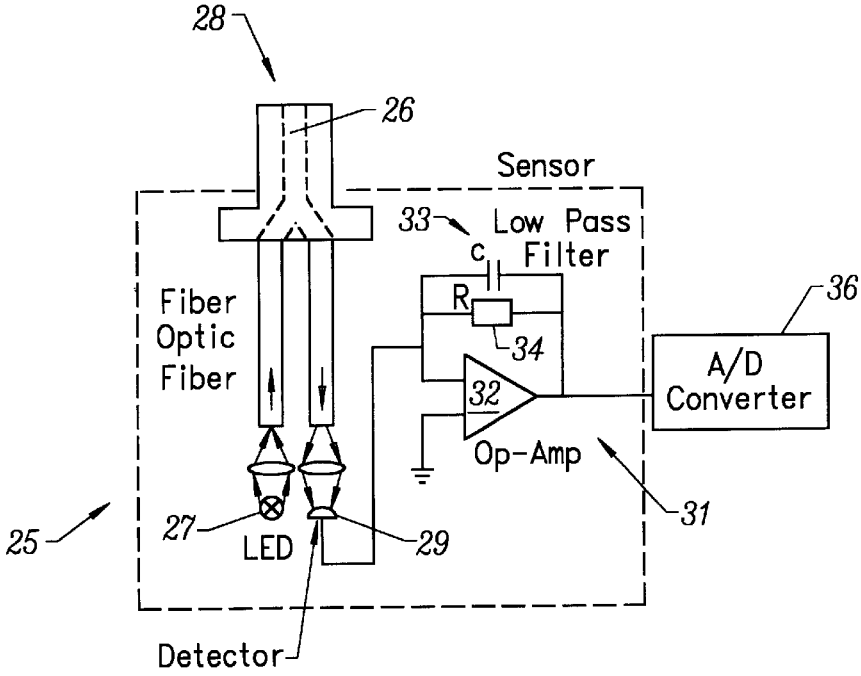
FIG. 6 is a schematic of the optical end point detection system according to one embodiment of the present invention.

An optical detection system, preferably a fiber optic reflectance system, is used in the present invention. Referring to FIGS. 3 and 6, one example of the present invention shows a bundle 26 of optical fibers which transmit light from a light source 27 such as a light-emitting diode, to a sensor tip 28. Other optical fibers in the bundle 26 transfer light reflected from the surface of the wafer to a photodetector 29 connected to an amplifier system 31 including an operational amplifier 32 and low pass filter comprising capacitor 33 and resistor 34. The analog output from the operational amplifier is applied to an analog-to-digital converter 36, and then to a processing system which processes the digitized signal in a manner to be presently described. Such an fiber optic system is commercially available, such as a Philtec D64 sensor system.

In the preferred embodiment, the emitting and receiving fibers are in parallel and are randomly distributed in the bundle 26 and oriented generally normal to the wafer surface, although other orientations are acceptable. According to the present invention, the light-emitting diode is selected to emit light at a wavelength that maximizes the differences in reflection of the particular materials on the surface of the wafer. In one example, where a copper layer is to removed to reveal copper leads placed within intervening silicon dioxide layers, the light-emitting diode is selected to emit light at a wavelength of preferably about 880 nm, which is in the range having optimal differences in reflection. Those skilled in the art will recognize that the wavelength providing the most optimal difference in reflectance between the conductive and insulating materials will vary depending on the types of the materials, but that such wavelengths can be determined based on the teaching of the present invention.

The gap distance "g" between the sensor tip 28 and the wafer 22 is important to minimize fluctuations in the reflectance readings. Accordingly, preferably the sensor holder of the present invention is designed to allow gap adjustment. In one example, the sensor holder is comprised of a rigid housing with a nut which receives a threaded sensor tip that screws onto the nut and the gap between the sensor tip 28 and the wafer is adjusted up or down simply by twisting. Other sensor holder configurations may be used so long as they provide a rigid structure that allows adjustment relative to the wafer surface.

Figure 7:
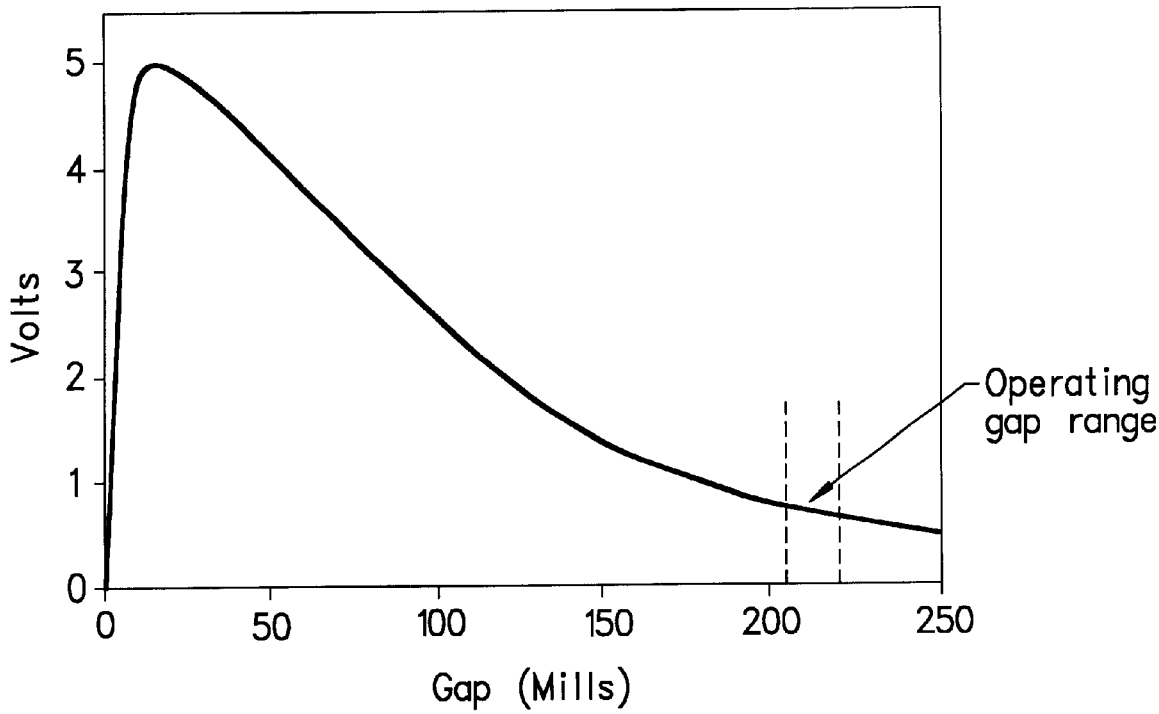
FIG. 7 shows the output voltage as a function of the gap between the end of the fiber optics bundle and the wafer surface for one exemplary embodiment of the present invention.

Increasing the gap distance "g" can minimize the influence of gap changes as illustrated in FIG. 7 which shows the characteristics of the sensor of the exemplary embodiment. Specifically, each sensor will exhibit a certain voltage at a certain gap distance, as can be determined experimentally or may be available form the manufacturer of the sensor. It is preferred to select a gap distance where the slope of the curve flattens out. In the exemplary embodiment, using a Philtec sensor the gap distance "g" is preferably in the range of about 200 to 250 mils, and more preferably in the range of about 200 and 225 mils. While, one specific example is shown, other suitable sensors may be used to measure reflectance of a wafer surface. However, any suitable sensor must be capable of projecting light onto the wafer and gather the reflected light, and providing an output signal for processing.

To provide in-situ monitoring of the CMP process, the method and apparatus of the present invention employs the sensor tip, inserted in at least one window 36 formed in the rotating platen, to view the wafer during polishing as shown in FIG. 3. The fiber optics bundle with the light emitting diode detector and amplifier are mounted for rotation with the platen. A suitable slip coupling (not shown) may be used to transmit the analog signals through a rotating interface to the analog-to-digital converter 36. More than one window may be formed in the rotating platen, each having a sensor tip inserted therein for viewing multiple locations at the same time. When using multiple sensors, sampling techniques known in the art may be used to process the signal. The window may be of any shape and size, and is limited only by being able to adequately house the sensor tip, an preferably provides a small footprint to minimize the impact on the polishing process.

Figure 5:
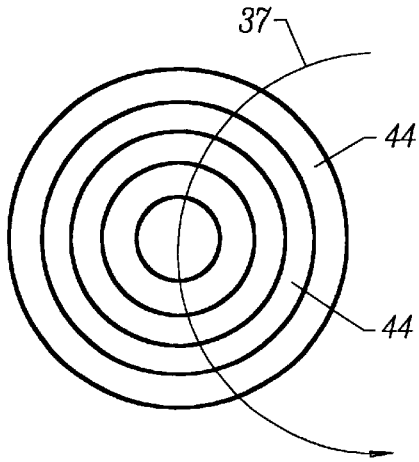
FIG. 5 schematically shows the wafer surface with concentric annular areas and the path of the scanning window across the wafer according to the present invention.

Of particular advantage, the window 36 may be placed in any desired location such that it traverses a desired region of the wafer during polishing. In the preferred embodiment, the center-to-center offset distance of the wafer and the window are selected such that the sensor tip views the wafer in a scanning arc which travels through the center of the wafer. The scan line 37 shown in FIG. 5 illustrates one example of the scanning arc which travels through the center of the wafer. The polishing may be axis-symmetric, and thus a measure of the reflectance intensity at a distance from the wafer center is expected to be the same for all zones of equal radii. In the instance when polishing is axis-symmetric, the polishing level can be inferred for all other radii in any annular zone, as long as the sensor traverses across the center of the wafer.

Alternatively, different scanning arc trajectories may be selected by changing the center-to-center offset and/or by varying the rotational speeds of both the wafer carrier and the platen. For example, up to a 10% rotational speed offset (i.e. difference in speed between the wafer carrier and the platen) allows one to "step" the trajectory across the wafer.

The optical detection system needs to be protected from the polishing environment. This is accomplished by providing the window(s) 36 in the polishing pad 23, flush with or slightly recessed from the pad surface. Preferably, the window has similar wear properties as those of the pad thus preventing any damage to the surface of the wafer.

Figure 4:
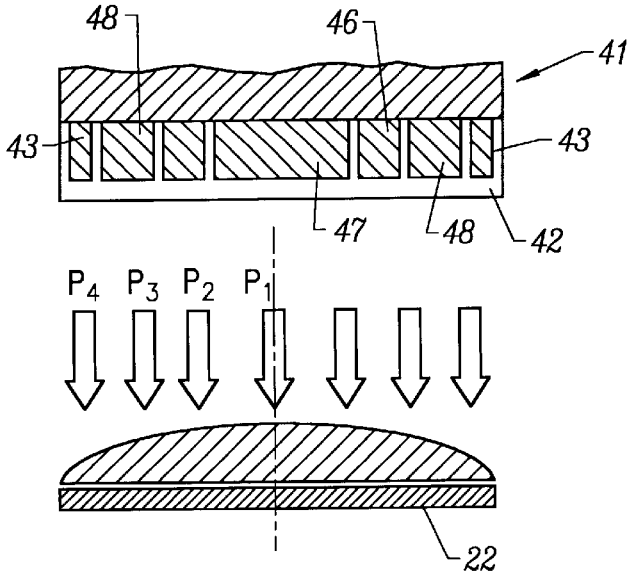
FIG. 4 shows the diaphragmed pressure pad of the wafer carrier associated with a metalized wafer in accordance with one embodiment of the present invention.

Of significant advantage the present invention provides for monitoring the CMP process in certain localized regions or zones. In particular, a plurality of zones are defined on the surface of the wafer and correspond to zones formed in a membrane that engage the wafer. Preferably, the zones are annular; however, the zones may be formed of any suitable shape. Referring to FIGS. 4 and 5, one example of these zones are schematically illustrated, and are further described in co-pending application Ser. No. 09/628,563 wherein a wafer carrier with compartmentalized membranes engages the upper surface of the wafer and urges the wafer across the polishing pad. In this example, the compartments or chambers are in the form of concentric rings and define annular zones whereby the pressure between the wafer and the polishing pad is controlled by these annular zones which are adjacent to the wafer. Thus, by varying the pressure in the annular zones, the rate of polishing on the wafer is controlled at localized regions on the wafer corresponding to each of the annular zones.

More specifically, as further described in the above referenced co-pending application, a wafer carrier is provided which includes a flexible membrane that engages the wafer and urges or presses the wafer against the polishing pad. FIG. 4 schematically illustrates such a wafer carrier 41 which includes a membrane 42 having concentric compartments 43 formed therein and sealed which define the multiple chambers or cavities 46. The chambers 46 form concentric rings with a center chamber 47 surrounded by one or more outer chambers 48. These chambers are defined as annular zones or regions. Each of the chambers separately engage the undersurface of the wafer 22, and thus define localized regions on the wafer surface corresponding to the adjacent annular zones. The pressure applied to the wafer 22 is separately controlled by the pressure in each of the chambers as indicated the arrows $P_1$–$P_4$ in FIG. 4. The result is that concentric zones or regions 48 on the wafer surface can be polished at different rates by controlling the pressure in the corresponding chambers 46. Although four zones are shown in the figures, any suitable number of two or more zones may be defined. Further, the zones may be of a different shape and are not limited to an annular shape, although an annular shape is preferred for the outer zones. In the preferred embodiment, the membrane contains four chambers defining four zones, the four zones being comprised of one circular center zone and three annular concentric zones.

As the sensor traverses across the wafer during polishing, it monitors the polishing progress in the area of the wafer corresponding to one or more of the concentric surface zones. Non-uniform removal of material on the wafer surface tends to occur in patterns concentric about the central normal axis of the wafer due to the rotation of the wafer during polishing. The sensor detects the condition of the wafer a given distance away from the center, and a similar reflectance measurement may be assumed for all equal radii. As described in further detail below, this information regarding the condition of the wafer surface in the different zones is transmitted to a control system to produce a control signal which then selectively controls the pressure in the corresponding chambers behind the wafer as needed to selectively reduce wafer level non-uniformity during the CMP process.

Additionally, the sensor is sensitive to scattering effects due to topographic variations found on the surface material layer on the wafer, particularly when the surface material is copper, just before planarization or removal of the layer. These topographic variations are expected to become more planar during polishing and prior to removal, resulting in an increased reflectance signal. According to one embodiment of the present invention this information is used to ascertain the wafer surface planarity during polishing, and is then used to modify the process parameters to provide more effective and/or efficient polishing. Initially, low pressure gives better planarization and as planarity is reached as indicated by an increased reflectance signal, the process may be modified to higher pressure and velocity to give an increase in removal rate. Thus, the overall polishing time may be reduced. Thus, the present invention provides a method and apparatus for providing feedback control to adjust the CMP process parameters, in addition to monitoring the CMP process.

Figure 10:
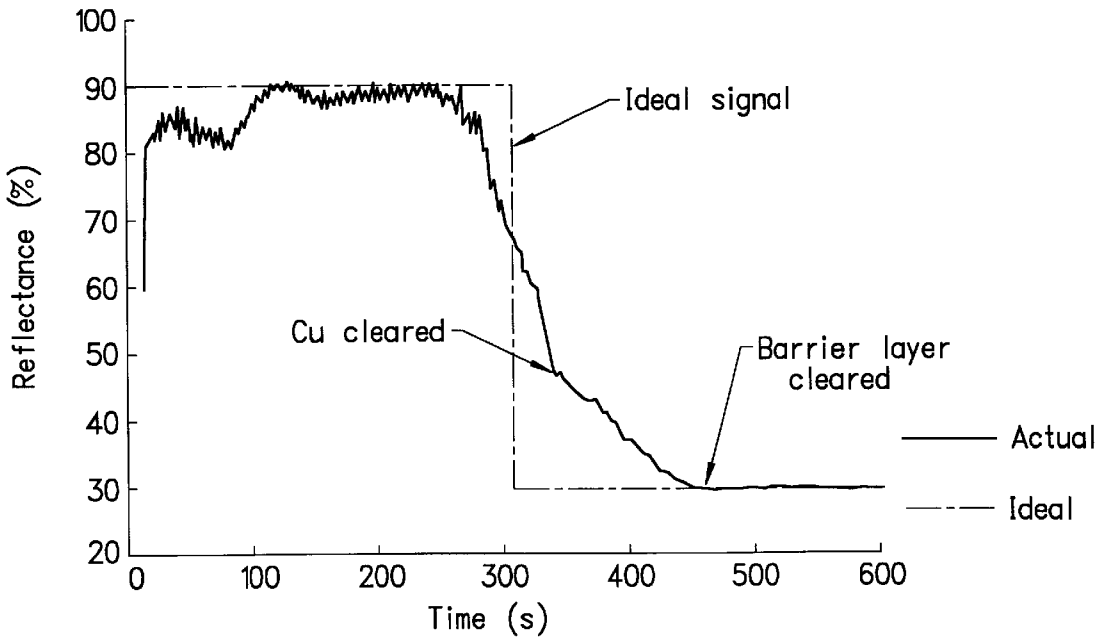
FIG. 10 illustrates one example of actual reflectance as a function of time as compared to an ideal signal.

In another aspect of the present invention, the desired end-point of the CMP process is detected in-situ during polishing. A variety of methods may be used to monitor the CMP process and to determine the end-point. In one example, the end point of the CMP process is determined by comparing the sensor signal to a predetermined threshold value. Referring to FIG. 10, there is a comparison of the ideal signal and an actual signal obtained during removal of a metal coating (copper blanket wafers). It is seen that there is a measurable drop in reflectance as first, the conductive copper layer is removed, and second when the barrier layer is removed.. Experimental results have shown a reasonable correlation between the ideal sensor signal and the actual sensor signal. Accordingly, a threshold reflectance value can be determined for each type of material and pattern type which can be used to compare against actual signals received during processing. When the threshold value is met in a given zone, pressure to the corresponding membrane chamber is reduced or removed to prevent further polishing in that region.

Further, in addition to the threshold value, the entire pressure profile within each zone from the last wafer run can be used to control the next wafer. This control system is referred to as a "feed forward" or run-to-run" control system. This type of system assumes that the nest wafer to be polished will exhibit similar topology and material removal characteristic within the same location or zone as the previous wafer. Thus, a similar pressure profile is applied to the chambers to carry out a similar polishing process.

Figure 9:
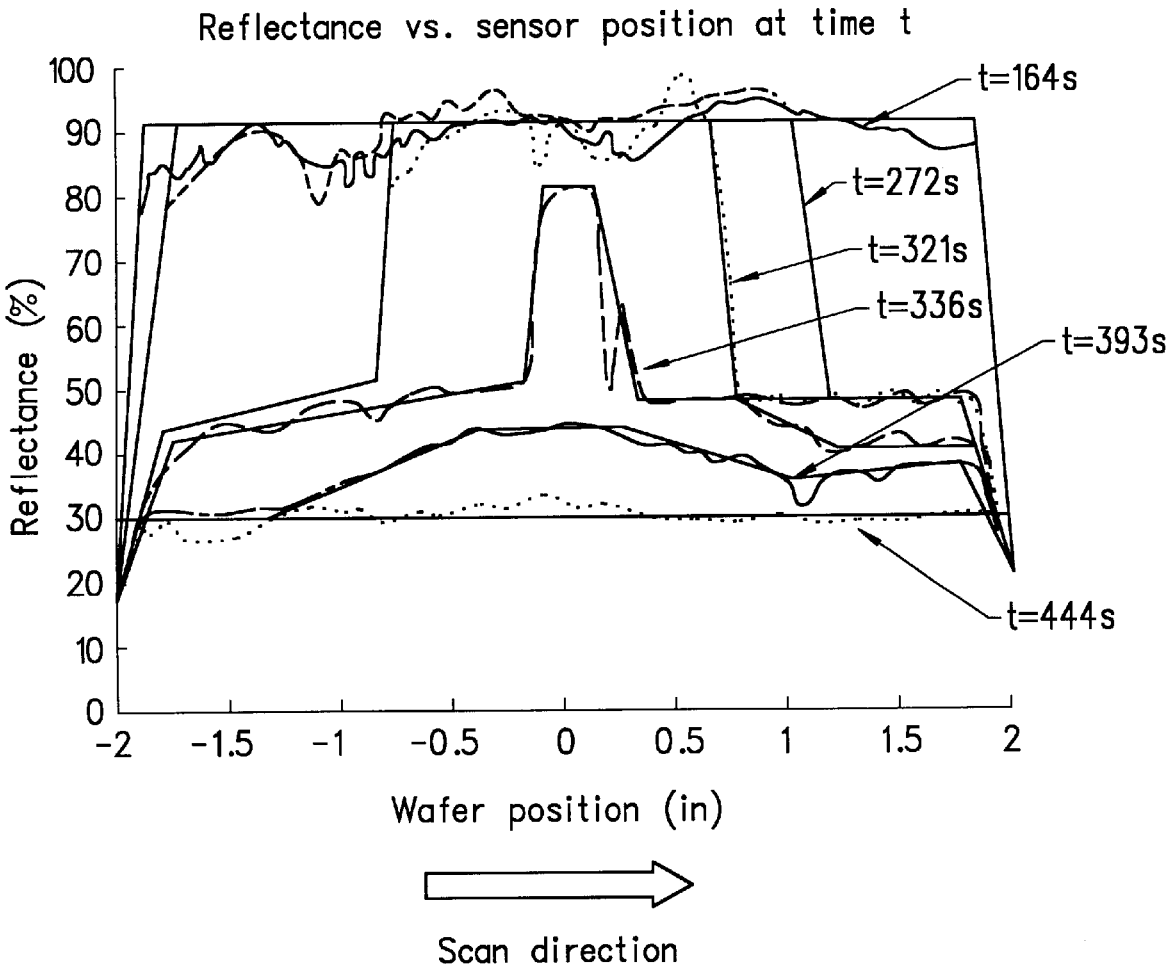
FIG. 9 shows the reflectance as a function of wafer position at various polishing times for one exemplary embodiment of the present invention.

FIG. 9 exhibits experimental results for tests conducted using the method and apparatus of the present invention. Wafers were polished having a blanket copper layer. The polishing took place until the blanket copper layer was removed to reveal a barrier layer of TaN. FIG. 9 plots the reflectance received as a function of the wafer position (in inches) for multiple polishing passes in time (t) over the wafer. A number of observations can be made. First, the material removal does occur substantially axis-symmetrically about the center of the wafer. The center of the wafer is the last localized region to be polished, and the edges of the wafer polish faster than the other regions of the wafer. This information can be used to create a pressure profile as described above, and sued to provide feed forward or run-to-run control. Specifically, the pressure is varied within each of the chambers corresponding to the localized position (i.e. zones) on the wafer to achieve the desired material removal. For example, the pressure in the outermost chambers which correspond to the edges of the wafer will be reduced at a selected time into the polishing process to account for the faster material removal rate in this region. The pressure may be reduced gradually, so that this region continues to be polished, but at a slower rate. Alternatively, the pressure may remain constant but will be at a lower value in this zone. Conversely, the center chamber which corresponds to the center position (or zone) of the wafer may receive increased pressure, the pressure may remain constant throughout the entire process, or a combination of both techniques may be used, since the center is the last zone to polish in this particular example.

Figure 11:
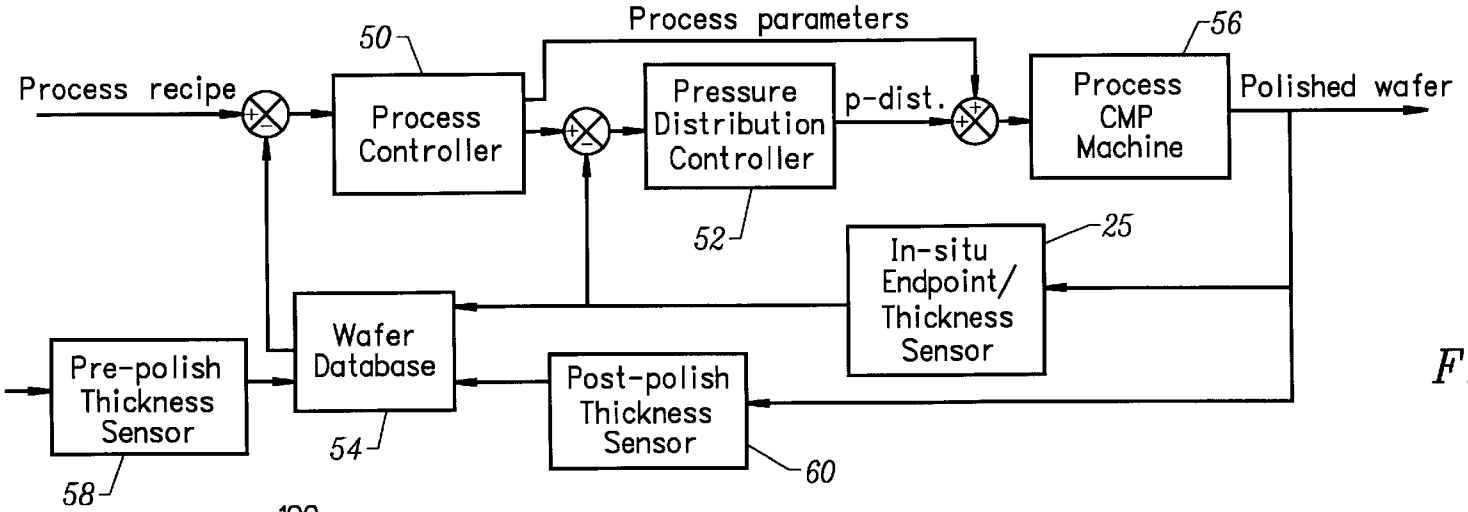
FIG. 11 is a schematic block diagram of a control loop for one example of a chemical mechanical polishing apparatus that may be used with the present invention.

FIG. 11 shows a block diagram of one example of a control system that may be used with the present invention.

The control system is comprised primarily of a process controller 50, pressure distribution controller 52, sensor 25, and a wafer database 54. The process controller 50 receives data establishing the process parameters or recipe, and sends commands to the CMP machine 56 to control the CMP process. Additionally, coupled to the process controller 50 and the CMP machine 56 is the pressure distribution controller 52 which controls the pressure within the membrane chambers in the wafer carrier as described above.

The pressure distribution controller 52 receives data via two routes. First, the pressure distribution controller 52 may receive data representative of the reflectance measurements in each of the zones on the wafer directly from the sensor 25. The pressure distribution controller 52 includes hardware and software configured to receive the reflectance measurements, determine the appropriate pressure adjustment needed (if any) within each zone, and then sends a signal to the CMP machine to selectively adjust the pressure within the subject zone as appropriate. The reflectance data from the sensor is also transmitted to, and stored in, the wafer database 54.

In an alternative embodiment, predetermined pressure profile values and/or threshold values for each of the zones are stored in the wafer database 54. These values are then transmitted to the process controller 50 or the pressure distribution controller 52. The pressure distribution controller compares these values to the actual, real-time reflectance values from the sensor 25 and sends a signal to the CMP machine 56 to adjust the pressure in each of the zones as appropriate. Additional data, such as the pre-polish thickness of the wafer 58 and/or the post-polish thickness of the wafer 60 may be sent to the wafer database to assist in determining the appropriate pressure adjustment.

In another embodiment of the present invention, model based detection may be used to monitor and control the CMP process. Specifically, model based control provides for the real time adjustment of the CMP process parameters to better tailor the CMP process to the most effective and efficient process. The detection systems described above focus primarily on selectively controlling the pressure in the zones to provide for substantially uniform polishing of the localized regions of the wafer. This minimizes the occurrence of over-polishing in some regions and under-polishing in other regions.

The model based detection and control system evaluates the amount of scattering in the reflectance signal received from the sensor. As described above, the inventors have found that the degree of scattering is indicative of the topography of the surface layer on the wafer. The extent of scattering of the signal may be evaluated based on statistical techniques such as determining the standard deviation and the variation in the mean as well as the shape of distribution. When a high level of scattering is seen the CMP process can be adjusted to give better planarization. As planarization proceeds, the surface layer the topographical variations begin to flatten out, and the scattering of the signal decreases. As this occurs the CMP process can again be adjusted to increase the removal rate of material from the surface of the wafer. These process adjustments can be made for example, by varying the relative velocity and applied pressure process parameters, and such adjustments can be made selectively within each of the zones as appropriate. Thus, the degree of scattering of the reflectance signal can used as an indicator of the material removal rate, and the polishing state of the wafer at certain localized regions on the wafer, and this information can be used to adjust the CMP process parameters.

In another aspect of the present invention, a method of chemical mechanical polishing is provided. In general, the method comprises the steps of: providing a CMP machine which includes a polishing pad and a wafer carrier having multiple chambers that allow for independently varying pressure within the chambers that urge against a wafer at corresponding localized regions on the wafer; measuring the reflectance of the surface of the wafer during polishing at each of the localized regions on the wafer; processing the reflectance data to determine the state of polishing within each of the localized regions; and independently adjusting the pressure within any one of the chambers responsive to the state of polishing within each of the corresponding localized regions.

Figure 12:
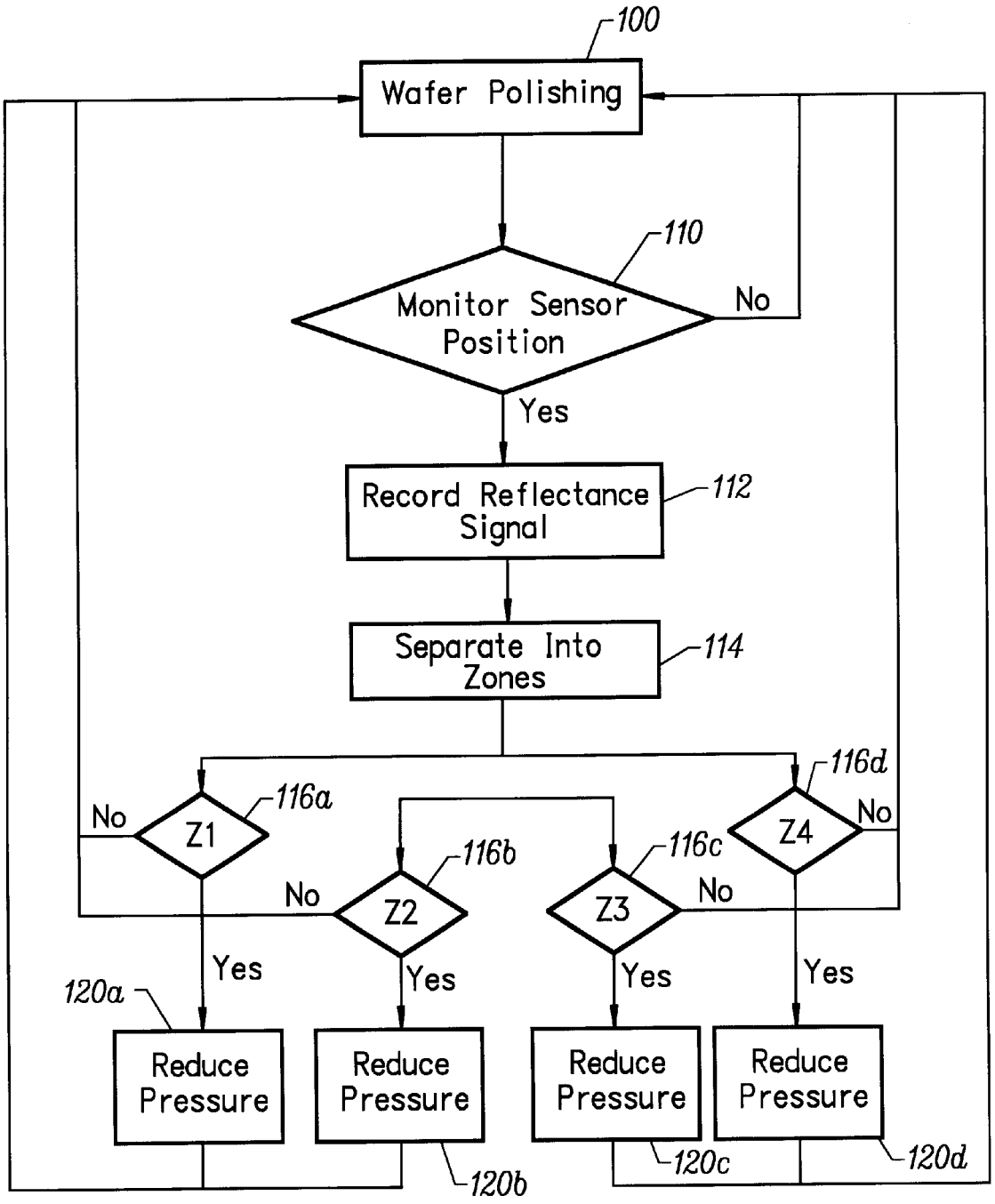
FIG. 12 is a flow chart illustrating processing of the output signal from the reflectance sensor for one embodiment of the present invention.

More specifically, in one embodiment the method of the present invention may be carried out as illustrated by the flowchart of FIG. 12. A CMP machine is provided and wafer polishing begins at step 100. The CMP machine includes means for varying the pressure against the wafer at localized regions, such as the flexible membrane having chambers that define zones on the wafer as described above. It should be noted however, that the present invention is not limited to this particular configuration, and other means that provide for independent control of the pressure at localized regions of the wafer may be used.

To provide for localized control of the pressure, and therefore localized material removal rate on the wafer, the sensor position is monitored at step 110 using conventional means. The reflectance signal is measured and recorded at step 112. At step 114 the signal measurements are separated into zone. The reflectance signal for each of the zones is then processed at step 116*a*–116*d*. As described above, processing of the signal may be performed in a variety of ways. For example, the reflectance signal may be compared to a threshold value or to a pressure profile. Based on the output of the processing of the signal at steps 116*a*–116*b*, a decision is made at step regarding whether the pressure needs adjusting in any one of the localized zones. The inquiry is made for each of the zones at steps 116*a*–116*d* (four zones in the exemplary embodiment), and the pressure is reduced when the inquiry is positive at steps 118*a*–118*d*.

Figure 13:
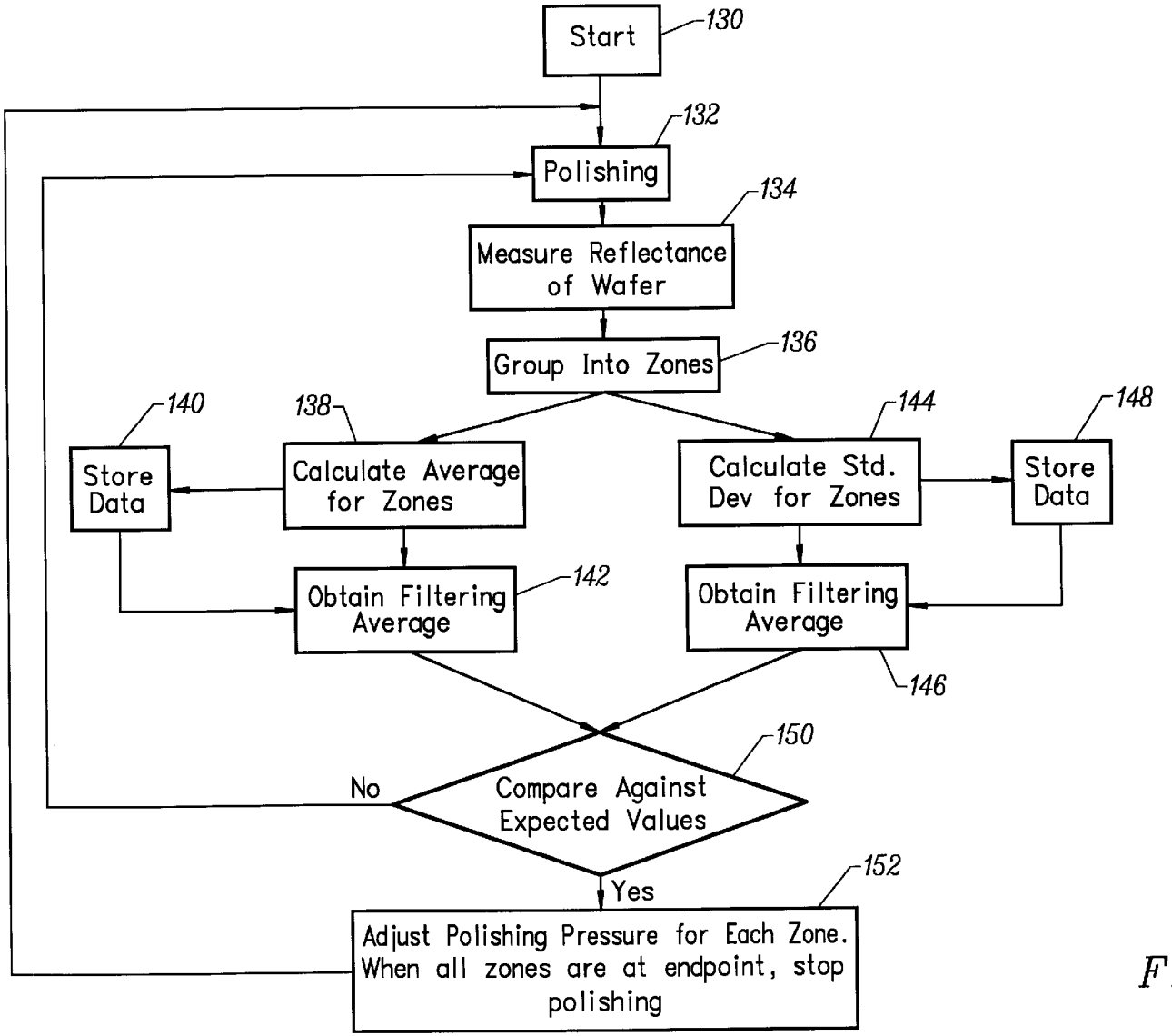
FIG. 13 is a flow chart illustrating the control of pressure at the various wafer zones in accordance with an alternative embodiment of the present invention.

FIG. 13 shows the method, particularly the processing step, in greater detail. The method begins at step 130 with polishing of the wafer at step 132. During polishing, the reflectance at various zones on the wafer is measured at step 134. The reflectance data measurements are separated or grouped into zones depending on the position of the sensor when the date was gathered at step 136. The grouped data is then individually processed. In one example, the grouped data is processed to calculate the average reflectance in each of the zones at step 138, data is stored at step 140, and a filtering average is obtained at step 142. The same reflectance data is also processed to calculate the standard deviation of the data in each of the zones, and to obtain the filtering average at steps 144 and 146. The standard deviation data is stored at step 148. The moving average values from both processing steps 142 and 146 are compared against previous, expected or threshold values at step 150. If the values do not differ in any of the zones, the polishing process continues without adjustment. If the values do differ in any one or all of the zones, the pressure in the zone(s) is independently adjusted accordingly at step 152. When all of the zones exhibit reflectance data that is indicative of end-point (as compared to previous, expected or threshold values) then the polishing process stops.

As taught by the foregoing description and examples, an improved method apparatus for chemical mechanical polishing of semiconductor wafers has been provided by the present invention. The foregoing description of specific embodiments and examples of the invention have been presented for the purpose of illustration and description, and although the invention has been illustrated by certain of the preceding examples, it is not to be construed as being limited thereby. They are not intended to be exhaustive or to limit the invention to the precise forms disclosed, and obviously many modifications, embodiments, and variations are possible in light of the above teaching. It is intended that the scope of the invention encompass the generic area as herein disclosed, and by the claims appended hereto and their equivalents.

What is claimed is:

1. A chemical mechanical polishing (CMP) apparatus comprising:

a rotating polishing platen having a first diameter, a wafer carrier for holding a wafer in cooperative relationship with said rotating platen, said wafer carrier having multiple chambers that allow for independently varying pressure within the chambers that urge against the wafer at corresponding multiple localized zones on the wafer, at least one window formed in said polishing platen whereby said window is periodically scanned across a wafer, an optical detection system carried on said platen for transmitting light through said window and receiving light reflected from the wafer through said window as it rotates past the wafer, to detect the reflectance of materials on the surface of the wafer at the multiple localized zones, and a controller, which receives reflectance signals representing the reflectance of materials on the surface of the wafer at the multiple localized zones from the optical detection system, and said controller is configured to process said reflectance signals to determine the state of polishing within each of the localized regions, and to selectively vary the pressure independently within each of the multiple chambers responsive to said state of polishing determination.

2. The CMP apparatus of claim 1 wherein the reflectance is used to stop the polishing independently within each of the multiple localized zones.

3. The CMP apparatus of claim 1 wherein said multiple chambers are formed in a flexible membrane and comprise a center chamber surrounded by one or more concentric chambers.

4. The CMP apparatus of claim 1 wherein the multiple chambers comprise a center circular chamber and three annular, concentric chambers.

5. The CMP apparatus of claim 1 wherein said optical detection system further includes at least one fiber optic sensor having a bundle of transmit and receive optical fibers terminating at a sensor tip, a light source which transmits light through the transmit optical fibers to the surface of the wafer, and a photodetector which receives reflected light from the surface of the wafer through the receive optical fibers.

6. The CMP apparatus of claim 5 wherein said transmit and receive optical fibers are oriented substantially normal to the surface of the wafer.

7. The CMP apparatus of claim 5 wherein the sensor tip is spaced apart from the surface of the wafer to form a gap, and the size of the gap is in the range of about 200 to 250 mils.

8. The CMP apparatus of claim 5 wherein the light source is a light emitting diode which emits light at a wavelength of about 880 nm.

9. The CMP apparatus of claim 1 wherein the materials on the surface of the wafer are any one of, or a combination of, conductive, insulating or barrier materials.

10. The CMP apparatus of claim 9 wherein said materials may be patterned on the surface of the wafer.

11. The CMP apparatus of claim 1 wherein the window scans through the center of the wafer.

12. A method of chemical mechanical polishing (CMP) of a semiconductor wafer, comprising the steps of:

providing a CMP machine which includes apolishing pad and awafer carrier having multiple chambers that allow for independently varying pressure within the chambers that urge against a wafer at corresponding localized zones on the wafer;

measuring the reflectance of the surface of the wafer during polishing at each of the localized zones on the wafer;

processing the reflectance data to determine the state of polishing within each of the localized zones; and independently adjusting the pressure within any one of the chambers responsive to the state of polishing within each of the corresponding localized zones.

13. The method of claim 12 wherein the step of independently adjusting further comprises:

reducing or stopping the chemical mechanical polishing, independently within each zone when a change in the reflectance is measured in that zone.

14. The method of claim 13 wherein the chemical mechanical polishing is reduced or stopped in a zone when the change in reflectance is in the range of about 25 to 60%.

15. The method of claim 13 wherein the chemical mechanical polishing is reduced or stopped in a zone when the change in reflectance exceeds a predetermined threshold value.

16. The method of claim 12 wherein the step of independently adjusting further comprises:

reducing or stopping the chemical mechanical polishing, independently within each zone according to prior reflectance measurements.

17. The method of claim 12 further comprising:

detecting the amount of scattering in the reflectance data;

determining the degree of topographical variations on the surface of the wafer based on the amount of scattering at the localized zones; and controlling the polishing process at the localized zones on the wafer responsive to said topographical variations.

* * * * *